US010632754B2

(12) United States Patent
Uyama et al.

(10) Patent No.: US 10,632,754 B2
(45) Date of Patent: Apr. 28, 2020

(54) PERFORATED SUBSTRATE PROCESSING METHOD AND LIQUID EJECTION HEAD MANUFACTURING METHOD

(71) Applicant: CANON KABUSHIKI KAISHA, Tokyo (JP)

(72) Inventors: Masaya Uyama, Kawasaki (JP); Tadanobu Nagami, Yamato (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 56 days.

(21) Appl. No.: 16/154,977

(22) Filed: Oct. 9, 2018

(65) Prior Publication Data

US 2019/0111682 A1 Apr. 18, 2019

(30) Foreign Application Priority Data

Oct. 13, 2017 (JP) ..... 2017-199510

(51) Int. Cl.
*B41J 2/16* (2006.01)

(52) U.S. Cl.
CPC ..... *B41J 2/1629* (2013.01); *B41J 2/1603* (2013.01); *B41J 2/1628* (2013.01); *B41J 2/1631* (2013.01); *B41J 2/1632* (2013.01); *B41J 2/1635* (2013.01); *B41J 2/1642* (2013.01); *B41J 2/1645* (2013.01); *B41J 2/1646* (2013.01)

(58) Field of Classification Search
CPC ..... B41J 2/1635; B41J 2/1642; B41J 2/1631; B41J 2/1646; B41J 2/1628; B41J 2/1603; B41J 2/1645
USPC ..... 216/17, 19, 27, 41, 49
See application file for complete search history.

(56) References Cited

FOREIGN PATENT DOCUMENTS

JP 9-11478 A 1/1997

*Primary Examiner* — Binh X Tran
(74) *Attorney, Agent, or Firm* — Venable LLP

(57) ABSTRACT

A perforated substrate having a first surface, a second (opposite) surface, a plurality of through holes running through the substrate from the first surface to the second surface and an etching object arranged on the first surface, is processed by forming a coating layer containing a resin material on the etching object, then allowing part of the resin material to drop into each of the through holes so as to close each of the through holes at least partly with the dropped resin material, then patterning the coating layer such that the coating layer is left on each of the through holes as mask while at least part of the coating layer covering the etching object is removed to expose the etching object; and etching the exposed etching object under a condition where each of the through holes is closed at least partly with the resin material.

14 Claims, 5 Drawing Sheets

PERFORATED SUBSTRATE PROCESSING METHOD AND LIQUID EJECTION HEAD MANUFACTURING METHOD

BACKGROUND OF THE INVENTION

Field of the Invention

The present invention relates to a perforated substrate processing method and also to a liquid ejection head manufacturing method utilizing the perforated substrate processing method.

Description of the Related Art

Japanese Patent Application Laid-Open No. H09-011478 describes an inkjet recording head manufacturing method including at least (1) a step of forming through holes for supplying ink through a substrate having ink ejection energy generating elements formed thereon and (2) a step of forming a protective film layer on each of the walls of the through holes. Japanese Patent Application Laid-Open No. H09-011478 also describes that the protective film layers are made to operate also as protective film layer on the ink ejection energy generating elements.

When a method of gasifying liquid by heating the liquid and utilizing the volume expansion attributable to the liquid gasification is employed as a liquid (ink) ejection method, heater elements, which are a sort of electrothermal transducers, are more often than not employed as ink ejection energy generating elements.

If the protective film layer (ink-resistant film) is left to remain on the heater elements, the efficiency of propagating thermal energy to the liquid to be ejected can fall to in turn increase the energy loss. Therefore, the protective film layer that is left on the heater elements is preferably removed in order to raise the thermal efficiency of the heater elements.

A method as described below may be used to secure the protective film layer on the areas that require it (e.g., on the inner walls of the through holes) and at the same time remove the protective film layer only from the areas that do not require it (e.g., areas on the heater elements). First, protective film layer is formed on predetermined areas of the substrate having through holes formed through it. Then, a photoresist layer is formed on the substrate to cover (and close) the through holes and the photoresist layer is subjected to a patterning operation to produce a resist pattern (that operates as etching mask). Finally, (the etching object, which is the unnecessary part of) the protective film layer is subjected to an etching process, using the resist pattern as etching mask, to etch the protective film layer.

However, when an etching mask is produced by using photoresist to cover the through holes and there exist one or more through holes that have a size larger than the specified size or that are formed at positions displaced from the specified positions, there can arise instances where the etching mask for covering the through holes cannot completely cover those through holes. Then, the insides of those through holes that should not be etched will be etched by the etching solution or the etching gas that is being employed, in the subsequent etching process.

What is worse, the etching solution or the etching gas can sometimes get to the rear surface of the substrate by way of those non-standardized through holes to undesirably etch the insides of the through holes formed to show a desired size at desired positions. Thus, the etching in the inside of a single non-standardized through hole can adversely affect some or all of the remaining through holes or the etching of a single chip can adversely affect some or all of the remaining chips to consequently lower the production yield of wafers.

SUMMARY OF THE INVENTION

In an aspect of the present invention, there is provided a perforated substrate processing method having a step of etching an etching object on a perforated substrate, the substrate having a first surface, a second surface located opposite to the first surface, and a plurality of through holes running through the substrate from the first surface to the second surface, wherein the etching object is arranged on the first surface of the perforated substrate at least around the through holes without closing the through holes, the method including: a step of preparing the perforated substrate; a step of forming a coating layer containing a resin material on the first surface of the perforated substrate; a closing step of allowing part of the resin material to drop into each of the plurality of through holes and so as to close each of the through holes at least partly with the dropped resin material; a patterning step of leaving the coating layer on each of the through holes as mask while removing at least part of the coating layer covering the etching object to expose the etching object; and a step of etching the exposed etching object under a condition where each of the through holes is closed at least partly with the resin material.

In another aspect of the present invention, there is provided a method of manufacturing a liquid ejection head having an element substrate including energy generating elements for ejecting liquid and liquid supply ports for supplying liquid, flow paths respectively communicating with the corresponding liquid supply ports and a nozzle layer including ejection orifices respectively communicating with the corresponding flow paths to eject liquid, the method including: a step of forming a plurality of liquid supply ports on a substrate having a first surface, a second surface located opposite to the first surface, and energy generating elements arranged on the first surface, the liquid supply ports running through the substrate from the first surface to the second surface; a step of forming a protective film covering the first surface, the second surface and an inner wall surface of each of the liquid supply ports; a step of etching at least parts covering the energy generating elements of the protective film; and a step of forming the flow paths, each communicating with at least one of the liquid supply ports, and the nozzle layer having the ejection orifices communicating respectively with the corresponding flow paths, on the first surface, wherein the step of etching the protective film is executed by utilizing the above-defined perforated substrate processing method.

Further features of the present invention will become apparent from the following description of exemplary embodiments with reference to the attached drawings.

DESCRIPTION OF THE EMBODIMENTS

In an aspect of the present invention, the object of the invention is to provide a perforated substrate processing method that can suppress the adverse effect of an operation of etching the etching object on a perforated substrate having a plurality of through holes that is attributable to a single through hole and affects the remaining through holes. In another aspect of the present invention, the object of the invention is to provide a liquid ejection head manufacturing method that can improve the production yield of wafers by utilizing the above perforated substrate processing method.

According to the present invention, the etching operation of the perforated substrate processing method is conducted under a condition where the resin material is buried (filled) in the inside of each of the through holes. Then, as a result, the occurrence of the problem that the through holes are etched at the insides thereof by the etching solution or the etching gas being used for the perforated substrate processing method is suppressed at the time of preparing a perforated substrate by the existence of the resin material buried in the insides of the through holes even in an instance where some of the through holes are displaced from their proper positions and/or some of the through holes show an increased planar size. Furthermore, the occurrence of the problem that the etching solution or the etching gas flows around and gets to the rear surface of the substrate is suppressed. Thus, consequently, the occurrence of the problem that any adverse effect attributable to a single through hole affects the through holes located around and adjacent to the former through hole is also suppressed and hence the occurrence of the problem that the adverse effect of a single chip affects the chips located around and adjacent to the former chip is suppressed to make it possible to improve the production yield of wafers.

Now, the present invention will be described in greater detail by referring to the attached drawings. Note, however, the following description by no means limits the scope of the present invention and is provided only to satisfactorily explain the present invention to those who have ordinary knowledge relating to the technical field of the present invention. Also note that FIGS. 1A through 1G are schematic cross-sectional views of a perforated substrate, illustrating so many steps of an embodiment of perforated substrate processing method according to the present invention and FIGS. 3A through 3D are schematic cross-sectional views of two perforated substrates having different through holes that can be used for the purpose of the present invention.

<Perforated Substrate>

Figure 1A:
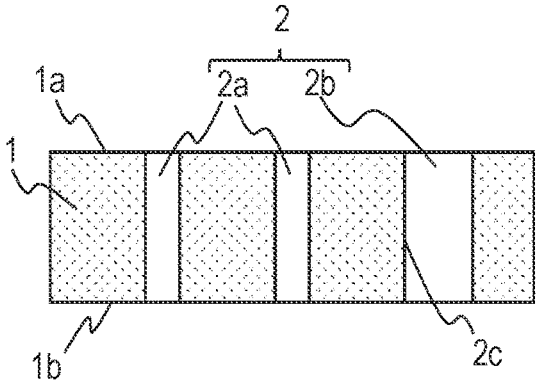
FIGS. 1A, 1B, 1C, 1D, 1E, 1F and 1G are schematic cross-sectional views of a perforated substrate, illustrating so many steps of an embodiment of perforated substrate processing method according to the present invention.

As seen from FIGS. 1A through 1G (FIGS. 1A, 1B and 1E in particular), a perforated substrate 10 that can be used for the purpose of the present invention includes at least a substrate 1, a plurality of through holes 2 and an etching object 3*a*. As shown in FIG. 1A, the substrate 1 has a first surface 1*a*, a second surface 1*b* that is the surface located opposite to the first surface. The first surface 1*a* and the second surface 1*b* may be in parallel with each other. There are no particular limitations to the material of the substrate and an appropriate material can be selected for the substrate 1 depending on the application thereof. For example, a silicon substrate may be used for the substrate 1.

Figure 3A:
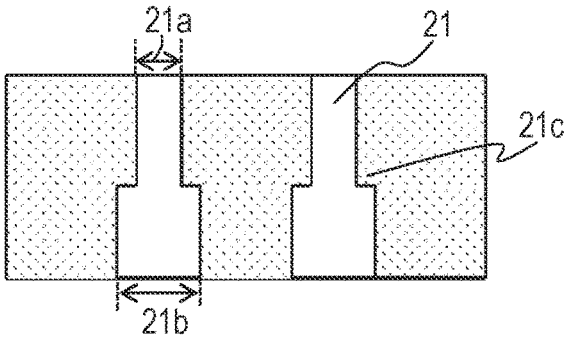
FIGS. 3A, 3B, 3C and 3D are schematic cross-sectional views of perforated substrates, showing two different forms of through holes that can be used for the purpose of the present invention.

The plurality of through holes 2 (2*a*, 2*b*) run through the substrate 1 from the first surface 1*a* to the second surface 1*b* of the substrate 1 (typically in a direction perpendicular to the surfaces of the substrate) and hence are open both at the first surface 1*a* and the second surface 1*b*. There are no particular limitations to the profile of the through holes. In other words, the profile of the through holes may appropriately be determined depending on the application thereof (e.g., the application of the liquid supply ports, the application of the vias or the like). For example, the hole diameter of each of the through holes at the first surface may be equal to the hole diameter of the through hole at the second surface as shown in FIG. 1A. Alternatively, the hole diameter of each of the through holes at the first surface may differ from the hole diameter of the through hole at the second surface. For example, the hole diameter 21*b* of each of the through holes at the second surface may be greater than the hole diameter 21*a* of the through hole at the first surface. In other words, the inner wall of the through hole 21 may have a step 21*c*, as shown FIG. 3A. More specifically, the through holes preferably have a step at the inner walls thereof as shown in FIG. 3A from the viewpoint of fully exploiting the advantages of the present invention. For example, each of the through holes may run through the substrate in a direction that is (substantially) perpendicular to the surfaces of the substrate and also may have a step attributable to the difference between the hole diameter thereof at the first surface and the hole diameter thereof at the second surface of the substrate.

Figure 3C:
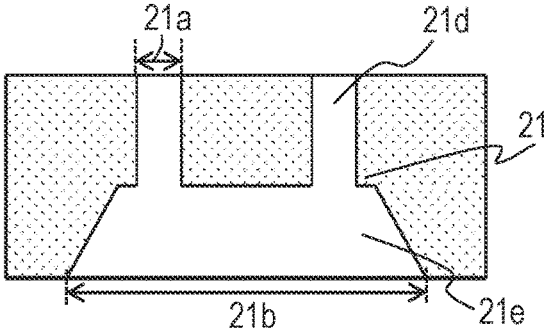

Still alternatively, the through holes may show a profile as illustrated in FIG. 3C. More specifically, the through holes may include first through holes (which may typically be individual liquid supply ports) 21*d* and a second through hole (which may be a common liquid supply port) 21*e* and the inner walls of the through holes may have a step 21*c*. Such a profile also can fully exploit the advantages of the present invention. Note that, in the instance of the through holes shown in FIG. 3C, the hole diameter of the second through hole 21*e* varies in the thickness direction of the substrate (in the vertical direction of the drawing) and the second through hole 21*e* shows a tapered profile so that its hole diameter is gradually decreased toward the first surface.

Furthermore, the plurality of through holes 2 may have a same profile or respective profiles that are different from each other. Note that, the present invention is particularly advantageous when some of the through holes have profiles that differ from their intended profiles. Namely, the present invention is particularly advantageous when the through holes are formed at positions that are displaced from the respective proper positions and/or when the through holes have sizes that differ from their intended size. The present invention may also be advantageous of overcoming any unintended adverse effect of the patterning operation that is to be conducted prior to the etching operation (e.g., partial misalignment of the patterning position).

To illustrate the advantages of the present invention, FIG. 1A shows a through hole 2*a* having an intended diameter and a through hole 2*b* having a diameter greater than the intended diameter. The advantages of the present invention with regard to such a situation will be described in detail hereinafter.

The etching object 3*a* (see FIG. 1E) is arranged on the first surface 1*a* at least around the through holes 2 without closing the through holes. It operates as the object of the etching operation that is to be conducted in the etching step that will be described in greater detail hereinafter. The etching object 3*a* may be a film such as protective film or insulating film. There are no particular limitations to the material of the etching object so long as it can be removed by the etching operation. In other words, an appropriate material may be selected and employed for the etching object.

It is only necessary for the etching object 3*a* to exist around the through holes on the first surface and there are no particular limitations to the distance separating each of the through holes from the etching object. However, since the present invention is highly advantageous when the through holes are displaced from their intended positions and/or when the through holes have sizes greater than their intended size, the present invention will be highly effective when the etching object is produced at a position where it is reliably affected by such displacements and/or such size differences.

Figure 1B:
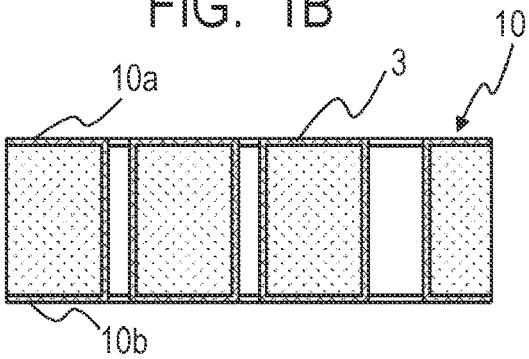

The perforated substrate 10 shown in FIG. 1B is provided with a film 3 that covers the first surface 10*a*, the second surface 10*b* and the inner wall surface 2*c* of each of the through holes (see FIG. 1A) and at least part of the film arranged on the first surface operates as the etching object 3*a*. For example, when each of the through holes is provided with a through electrode and the film 3 is to be formed as insulating film on the through electrodes, an SiO film or an $SiO_2$ film can advantageously be employed for the film 3. When the film 3 is to be formed as ink-resistant film for protecting the substrate against the ink in the inkjet recording head, a TiO film can advantageously be employed for the film 3. Note that the film 3 extends from the first surface 1*a* of the substrate 1 to the inner wall surface 2*c* of each of the through holes 2. Also note that the first surface 10*a* refers to the front surface of the perforated substrate 10 (the upper surface shown in FIG. 1B) and the second surface 10*b* refers to the rear surface (the lower surface shown in FIG. 1B) located opposite to the first surface 10*a*.

<Perforated Substrate Processing Method>

Figure 1C:
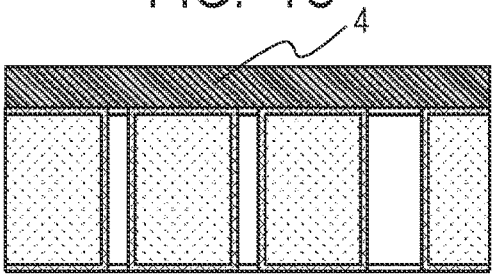
Figure 1D:
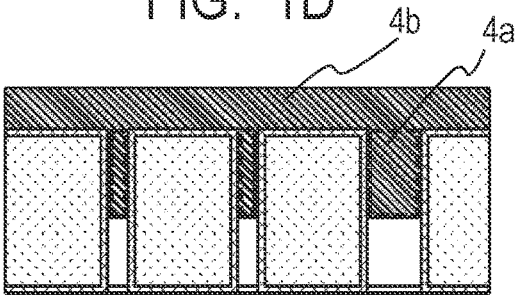
Figure 1E:
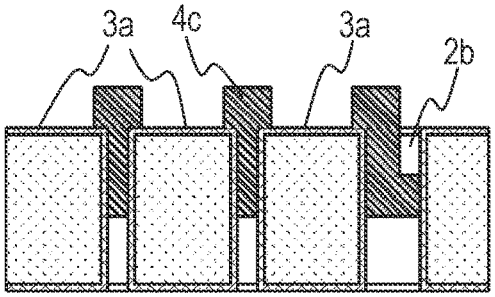
Figure 1F:
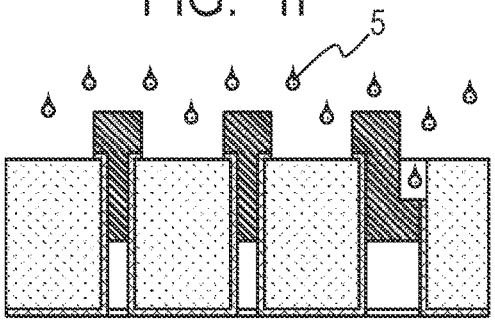

A perforated substrate processing method according to the present invention includes the following steps:

- a step of preparing a perforated substrate (a perforated substrate preparing step, FIG. 1B);
- a step of forming a resin material-containing coating layer on the first surface of the perforated substrate (a coating film layer forming step, FIG. 1C);
- a step of allowing part of the resin material to drop into each of the plurality of through holes of the perforated substrate and at least partly closing each of the through holes with the dropped resin material (a closing step, FIG. 1D);
- a step of leaving the coating layer on each of the through holes as mask and removing at least part of the coating layer covering the etching object to expose the etching object (a patterning step, FIG. 1E); and
- a step of etching the exposed etching object under a condition where each of the through holes is at least partly closed by the resin material (an etching step, FIG. 1F).

Figure 1G:
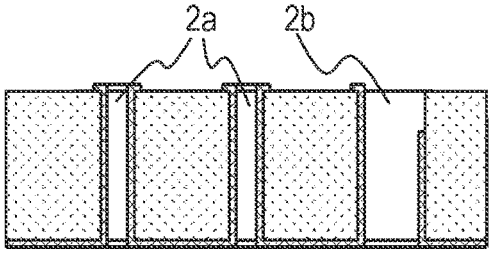

A perforated substrate processing method according to the present invention as defined above may additionally include the following steps:

- a step of removing the remaining coating layer (resin material) (a coating layer removing step, FIG. 1G).

Note that the above-described perforated substrate preparing step may include the following steps:

- a step of brining in a substrate having a first surface and a second surface located opposite to the first surface (a substrate bringing-in step); and
- a step of forming a plurality of through holes running through the substrate from the first surface to the second surface (a through hole forming step, FIG. 1A); and
- a step of forming a film covering the first surface and the second surface of the substrate and also the inner wall surface of each of the through holes (a film forming step, FIG. 1B).

Now, each of the above listed steps will be described in detail below.

(Perforated Substrate Preparing Step)

Firstly, as shown in FIG. 1A, a substrate (e.g., a silicon substrate) having a first surface 1*a* and a second surface 1*b* is brought in and a plurality of through holes 2 that run through the substrate (perpendicularly relative to the substrate surfaces) are formed (a through hole forming step). While there are no particular limitations to the method of forming through holes through the substrate, a dry etching technique such as CDE (chemical dry etching) or RIE (reactive ion etching) may typically be employed for forming the through holes. Note that, as pointed out above, FIG. 1A shows through holes 2*a* having an intended size and a through hole 2*b* having a size greater than the intended one.

Subsequently, as shown in FIG. 1B, a film 3 for covering the first surface 1*a*, the second surface 1*b* and also the inner wall surface 2*c* of each of the through holes 2 is formed (a film forming step). As described above, the film (which may typically be an SiO film, an $SiO_2$ film or a TiO film) will partly become the etching object 3*a* (see FIG. 1E). The etching object will be removed in an etching step that comes later so that the films will be made to show a desired pattern.

Note that there are no particular limitations to the method of forming the film 3 and an appropriate method may be selected depending on the required throwing power and the material of the film to be used. A film having a uniform film thickness can be formed on the desired area of the substrate typically by means of a thermal CVD (chemical vapor deposition) technique, an ALD (atomic layer deposition) technique or the like. Alternatively, a film (such as an $SiO_2$ film) can also be formed on the desired area by dipping the substrate in a liquid material of SOG (spin on glass) or the like and subsequently baking the substrate.

With the perforated substrate processing method of the present invention, it is sufficient that an etching object 3*a* is arranged at least around of each of the through holes on the first surface of the substrate without closing the plurality of through holes 2. In other words, a film as described above may or may not be formed on other parts of the substrate. Thus, a perforated substrate 10 as shown in FIG. 1B can be formed in the above-described manner.

(Coating Layer Forming Step)

Next, as shown in FIG. 1C, a resin material is made to adhere to the first surface 10*a* of the perforated substrate 10 to form a coating layer 4 for covering the etching object 3*a* and also the plurality of through holes 2. With regard to the method of forming the coating layer, there are no particular limitations to the method and any known method in the field of liquid ejection heads may be used to form the coating layer so long as the method can allow the resin material to adhere to the first surface 10*a*. More specifically, coating layer forming techniques that can be used for the purpose of the present invention include sputtering, spin coating and lamination using dry film resist.

Now, a lamination technique will be described below as an example. With a lamination technique, the resin material to be used is firstly turned into dry film and the dry film is laid on the first surface as laminate. In this way, a coating layer 4 that contains the resin material can be formed on the first surface.

While the thickness of the coating layer 4 can appropriately be determined depending on the quantity of the resin material for the filling operation and other factors in the filling step, which will be described hereinafter, the thickness of the coating layer 4 is preferably not less than 5 μm from the viewpoint of the cohesive power of the resist to be used and not more than 100 μm from the viewpoint of the performance of the pattern operation to be conducted by means of exposure and development.

Note that the resin material to be used at the time of forming the coating layer 4 may, if necessary, contain one or more additive agents (which may typically include a solvent and/or a photosensitive substance) in addition to resin (or rubber), which is the essential component of the resin material.

While the resin (or rubber) component to be used for the resin material may appropriately be selected, a material that shows a high degree of fluidity in the closing step, which will be described hereinafter, is preferably adopted for use. Note that, when forming the coating layer 4, the degree of fluidity of the resin material in the closing step can be raised by making the resin material contain (typically a small quantity of) solvent that can dissolve the resin component in addition to the resin component.

Besides, resin (or rubber) having a glass transition point (Tg) that can raise the fluidity of the resin material by heat is preferably employed as the resin (or rubber) component to be used for the resin material.

Additionally, resin (or rubber) selected from novolac resins, acrylic resins and cyclized rubbers can suitably be employed as the resin (or rubber) component to be used for the resin material because such resin (or rubber) can easily be removed in a later step.

When a novolac resin is employed as the resin component, propylene glycol monomethyl ether acetate (PGMEA) can advantageously be used as the solvent to be contained in the resin material for the purpose of raising the degree of fluidity. When, on the other hand, an acrylic resin is employed as the resin component, cyclohexanone can advantageously be used as the solvent. Finally, when a cyclized rubber is employed as the resin component, xylene can advantageously be used as the solvent.

Also note that many novolac resins have a glass transition point within the temperature zone between about 60° C. and about 100° C., although the glass transition point of resin is also affected by the molecular weight of resin. Any of such novolac resins may appropriately and advantageously be selected for use also from the viewpoint of easy handling.

The resin material may or may not be photosensitive. When a (typically positive-type) photosensitive resin material is employed, for example, naphthoquinonediazide (NQD) can be used as the photosensitive substance to be contained in the resin material. The content ratio of the resin component of the resin material, that of the solvent, that of the photosensitive substance and so on can appropriately be determined. In other words, there are no particular limitations to the content ratios of those components.

(Closing Step)

Subsequently, as shown in FIG. 1D, the resin material that is a component of the coating layer 4 is partly allowed to drop into each of the plurality of through holes 2 so as to close at least part of each of the through holes with the dropped resin material. Note that the expression of "at least part of each of the through holes" refers to "at least part of each of the through holes as viewed in the depth direction of the through hole (in the vertical direction of FIG. 1D). Accordingly, each of the through holes is closed in the closing step by the resin material at a part of its length. Thus, as a result, the first surface 10*a* of the perforated substrate cannot communicate with the second surface 10*b* thereof by way of any of the through holes because of the closed part of the through hole. Note that FIG. 1D shows closed parts (due to the dropped resin portion) 4*a* of the through holes and the coating layer 4*b* formed by the resin material and remaining on the first surface. The coating layer 4*b* is formed by the resin material that is not used to close the insides of the through holes and hence left on the first surface and covers the etching object 3*a* and the plurality of through holes 2. Also note that, in FIG. 1D, only a part of each of the through holes located close to the second surface 10*b* is not filled with the resin material, while all the remaining part of the through hole is filled with the resin material. However, alternatively, only a part of each of the through holes located close to the first surface 10*a* may be filled with the resin material or each of the through holes may entirely be filled with the resin material.

If, however, the amount of the resin material that drops into each of the through holes is greater than the amount of the resin material necessary for entirely filling the through hole and hence the resin material flows out onto the second surface 10*b* through the through hole, the resin material flown out onto the second surface 10*b* may disadvantageously affect the various operations of handling the surfaces of the substrate that come thereafter such as an operation of chucking the second surface 10*b*. For this reason, for the perforated substrate processing method according to the present invention, it is required to control the operation of allowing the resin material to drop into (and fill) at least part of the inside of each through hole so as to prevent the dropped resin material from flowing onto the second surface 10*b* of the perforated substrate.

While there are no particular limitations to the technique of allowing part of the resin material for forming the coating layer to drop into each of the through holes so long as the technique is suitable for improving the degree of fluidity of the resin material to be used when dropping the resin material, for example, a technique of heating the resin material for forming the coating layer may advantageously be employed. When a heating technique is employed, the resin material for forming the coating layer 4 can be softened to raise the degree of fluidity thereof by heating the resin material. Then, it is possible to allow the resin material to automatically drop into each of the through holes by utilizing the capillary phenomenon.

Furthermore, if the resin material to be used has a glass transition point, the fluidity of the resin material can be raised with ease by heating the resin material of the coating layer to a temperature higher than the glass transition point of the resin material. Then, the closing step can be executed very easily.

The glass transition point of the resin material is preferably not lower than 40° C. from the viewpoint of handling. When the resin material is a photosensitive resin material, the temperature of the glass transition point can vary before and after the exposure to light of the resin material. Thus, more specifically, the glass transition point of the resin material is preferably not lower than 40° C. before the exposure to light of the resin material.

The temperature to which the resin material is to be heated is preferably not higher than the temperature level at which the photosensitivity of the resin material is lost and the operation of peeling (removing) the coating layer is obstructed in the coating layer removing step that comes later. If the resin material is an NQD type (including NQD) novolac resin material, the temperature to which the resin material is to be heated is preferably not higher than 130° C.

While the amount of the resin material that is filled in each of the through holes to form a closed portion 4*a* there (the amount of the resin material to be filled in the closed portion 4*a* to be formed) can appropriately be selected depending on the planar size of the through hole and the depth of the through hole, it is preferably within the following range. For example, when the (intended) hole diameter of each of the through holes is not less than 10 μm and not more than 100 μm and the (intended) depth of each of the through holes is 200 μm, the resin material is preferably filled in each of the through holes by not less than 10 μm and not more than 180 μm. In other words, each of the through holes is preferably filled with the resin material to a depth that is not less than 5% and not more than 90% of the depth of the through hole. The depth of each of the through holes refers to the length of the through hole in the vertical direction in FIGS. 1A through 1C. When film 3 is formed on the first surface and around each of the through holes as shown in FIG. 1B, the depth (length) of the through hole includes the thickness of the film 3 on the first surface. Therefore, the depth of each of the through holes in FIG. 1D is the vertical length as measured from the surface of the film 3 formed on the first surface 1*a* (namely the first surface 10*a*) to the surface of the film 3 formed on the second surface 1*b* (namely the second surface 10*b*) in FIG. 1D.

Figure 3B:
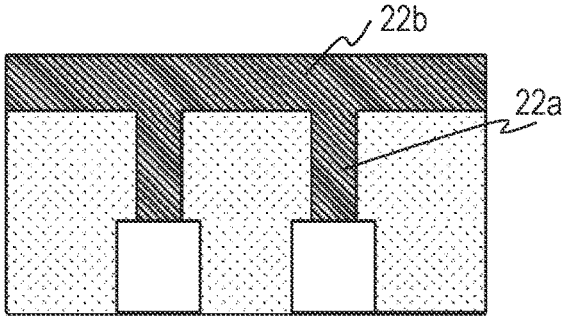
Figure 3D:
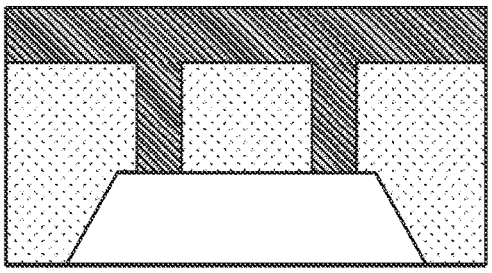

When the inner wall surface of each of the through holes 21 has a step 21*c* as described above by referring to FIGS. 3A and 3C, the resin material put into each of the through holes stops moving further down at the step 21*c* due to the capillary effect. Thus, the amount of the resin material of the closed portion 22*a* of each of the through holes can be controlled with ease as illustrated in FIGS. 3B and 3D and, at the same time, the profile of the coating layer 22*b* (formed by the resin material remaining on the first surface) can be retained with ease.

(Patterning Step)

Subsequently, at least part of the coating layer 4*b* covering the etching object 3*a* is removed, while the coating layer showing a predetermined profile is left on each of the through holes 21 so as to be used as mask 4*c*, so as to expose the etching object under a condition where each of the through holes is closed by the resin material as shown in FIG. 1E. In this patterning step, it is sufficient for the patterning operation to be executed under a condition where at least part of the resin material that has been allowed to drop (and filled) into each of the plurality of through holes 2 is left unremoved and each of the through holes is closed by the resin material that is left unremoved. Additionally, in this step, the coating layer showing a predetermined profile is left unremoved on each of the through holes (to be more specific, on the top part of each of the through holes) so as to be used as mask 4*c* in order to prevent the inside of each of the through holes from being eroded by the etching solution or the etching gas in the etching step that comes later. In the instance of the perforated substrate shown in FIG. 1E, at least there exists a through hole 2*b* that is adversely affected by the etching operation and part of the coating layer existing in an upper part of the through hole 2*b* is removed in the patterning step. However, since the resin material is filled in the inside of the through hole 2*b* in the closing step, the through hole 2*b* can maintain its closed condition throughout the patterning step.

Note that the coating layer left on each of the through holes can be made to show a (predetermined) appropriate profile. In other words, there are no particular limitations to the profile of the coating layer left on each of the through holes. With a specific patterning technique, when the resin material has photosensitivity, a pattern as described above can be formed by subjecting the resin material to an exposure process and a development process. When, on the other hand, the resin material does not have any photosensitivity, a pattern as described above can be formed by means of an etching operation (e.g., a dry etching operation), using resist for patterning the part of the coating layer covering the etching object.

Now, an instance where the resin material has photosensitivity and an instance where the resin material does not have any photosensitivity will be separately described in detail below.

The resin material has photosensitivity:

The resin material may either be a negative type photosensitive resin material or a positive type photosensitive resin material. An instance where the resin material is a positive type photosensitive resin material will be described below. For the purpose of the present invention, it is important that each of the through holes maintains the condition of being filled with (closed by) the resin material after the patterning step is over as pointed out above. More specifically, after the patterning step, at least part of the resin material filled in the closed portion 4*a* needs to be left unremoved even in a through hole 2*b* as shown in FIG. 1E.

Note that the part of the coating layer that covers the etching object is removed in the patterning step and therefore, if the resin material is a positive type photosensitive resin material (resist), the coating layer will be exposed to light down to a depth greater than the thickness of the coating layer 4*b* arranged on the first surface. For this reason, during the exposure operation, the coating layer 4*b* is preferably exposed to light under a condition where the closed portions 4*a* are not exposed to light. More specifically, the exposure operation is preferably executed under a condition where the resin material filled in the closed portion of each of the through holes is at least partly left unremoved and hence the through hole is closed by the resin material that is left unremoved. Either of the specific techniques as described below can suitably be employed for this purpose. They include a technique of controlling the light to be used for the exposure operation so as not to get to the bottom of the resin material filled in the closed portion of each of the through holes (exposure adjusting technique) and a technique of selecting a shallow depth of focus that does not allow exposure lighting to get to the bottom of the resin material filled in the closed portion of each of the through holes as a requirement of exposure lighting to be satisfied (lighting condition adjusting technique). For example, when the resin material is a photosensitive resin material that contains naphthoquinonediazide, which is a light-sensing substance, it is possible to expose the coating layer to light with ease without allowing the closed portion 4*a* of each of the through holes 2 to sense light because the resin material absorbs light to a large extent.

The resin material does not have any photosensitivity:

In an instance where the resin material does not have any photosensitivity (and hence is a non-photosensitive resin material), resist is applied onto the coating layer 4 in a separate step and a photosensitive resin layer is formed there to produce a desired pattern. Then, a resist pattern is formed by subjecting the photosensitive resin layer to an exposure process and a development process. The patterning step can be executed by using the resist pattern and etching the coating layer 4*b*. Note that, the etching operation is executed to a depth greater than the thickness of the coating layer 4*b* arranged on the first surface in the patterning step in order to remove the part of the coating layer that covers the etching object. For this reason, the depth by which the coating layer 4*b* is to be etched is preferably smaller than the depth of the resin material filled in each of the through holes. With such an arrangement, then, it is possible to leave at least part of the resin material in the inside of each of the through holes unremoved with ease.

The etching technique to be used for the patterning step may typically be selected from dry etching techniques. Above all, reactive ion etching (ME) may particularly preferably be employed for the patterning step. With the use of RIE, the surface coating layer can easily be etched and additionally the closed portions 4*a* can be left unetched with ease because ME allows the pattern of the coating layer to be formed with ease in an excellent manner and ME is characterized in that the etching rate is reduced as the coating layer is etched deeper. The etching conditions can appropriately be determined depending on the resin material to be used. When a resin component is employed for the resin material, the coating layer can be etched with ease by using $O_2$ gas (Etching Step)

Substantially, the etching object (the film of the region where the resin material has been removed) 3*a* that has been exposed at the surface as a result of the preceding patterning step as shown in FIG. 1F is subjected to a (single wafer) etching operation by using etching solution 5, which may typically be buffered hydrofluoric acid or the like, under a condition where each of the through holes is closed by the resin material.

Figure 2A:
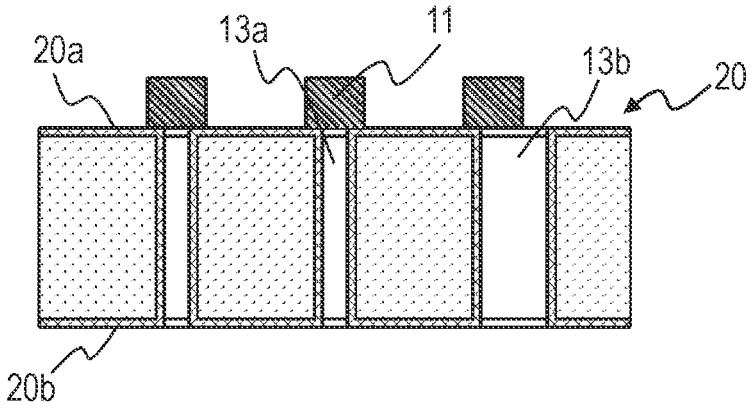
FIGS. 2A and 2B are schematic cross-sectional views of a perforated substrate, illustrating so many steps of a known perforated substrate processing method.
Figure 2B:
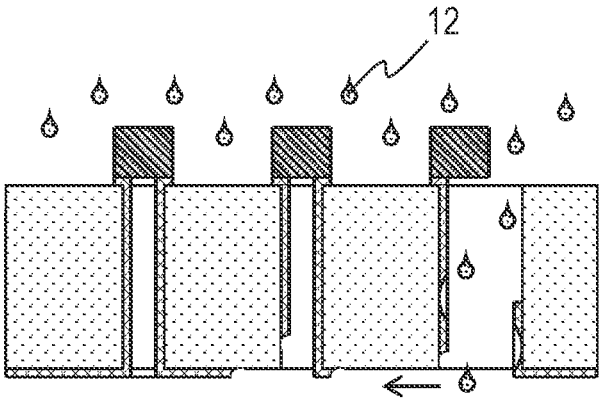

FIGS. 2A and 2B are schematic cross-sectional views of a perforated substrate, illustrating so many steps of a known perforated substrate processing method. FIG. 2A shows a perforated substrate 20 produced after a patterning step without executing a closing step, which is described earlier. Accordingly, each of the through holes of the perforated substrate shown in FIG. 2A is not filled with the resin material in the inside. In other words, each of the through holes does not have any closed portion. Additionally, in FIG. 2A, the top of the through hole 13*b* is not entirely covered by the coating layer (resin material) 11 and hence the first surface 20*a* and the second surface 20*b* of the perforated substrate communicate with each other by way of this through hole 13*b*. For this reason, while the etching object is subjected to a single-wafer etching operation as shown in FIG. 2B, the etching solution (buffered hydrofluoric acid or the like) 12 or the etching gas (fluorine radicals or the like) being employed to etch the etching object gets to the second surface 20*b* of the perforated substrate through the through hole 13*b*. Then, as a result, the etching solution or the etching gas that gets to the second surface 20*b* in turn gets into the neighboring through holes 13*a* by way of the second surface 20*b* of the perforated substrate to adversely affect the latter through holes. Ordinarily, a plurality of chips (liquid ejection heads) are prepared from a single substrate and hence, if such a phenomenon takes place, a chip having such adversely affected through holes can in turn adversely affect some of the remaining chips to remarkably reduce the production yield of chips.

To the contrary, according to the present invention, all the through holes 2 including the through hole 2*b* are closed by at least part of the resin material filled in the closed portions as shown in FIG. 1E. Therefore, if the top of one of the through holes is not entirely covered by the coating layer as shown in FIG. 1F, the etching solution or the etching gas being employed to etch the film 3 is prevented from getting to the second surface of the perforated substrate.

Thus, according to the present invention, unlike the prior art processing methods, the adversely affected through hole, if any, is prevented from in turn adversely affecting any of the remaining through holes. The net result will be a remarkably improved production yield of wafers.

(Coating Layer Removing Step)

Finally, the coating layer (resin material) is removed as shown in FIG. 1G. An appropriate coating layer removing technique can be selected depending on the resin material that is employed for the coating layer. For example, wet etching using a stripping solution may appropriately be employed for the coating layer removing step. Then, as a result, a perforated substrate from which the etching object has been removed can be obtained. With regard to the dimensionally problematic through hole 2*b*, the problem is carried over to the film patterning operation in the above-described patterning step. However, the problem does not affect any of the remaining through holes 2*a*. In other words, all the other through holes 2*a* that are free from the problem are left unaffected by the problem.

<Liquid Ejection Head>

A liquid ejection head that is obtained by a liquid ejection head manufacturing method according to the present invention, which will be described later can be mounted in a printer, a copying machine, a facsimile machine having a telecommunication feature, a word processor equipped with a printer or an industrial recording apparatus that is a composite machine produced by combining various processing units.

FIGS. 4A through 4I are schematic cross-sectional views of a perforated substrate, illustrating so many steps of an embodiment of liquid ejection head manufacturing method according to the present invention.

Figure 4A:
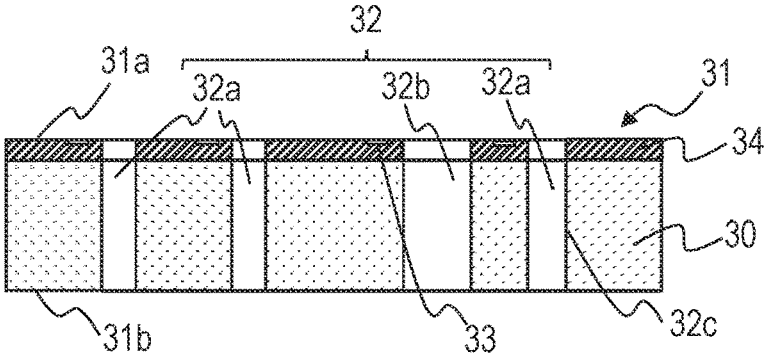
FIGS. 4A, 4B, 4C, 4D, 4E, 4F, 4G, 4H and 4I are schematic cross-sectional views of a perforated substrate, illustrating so many steps of liquid ejection head manufacturing method according to the present invention.
Figure 4B:
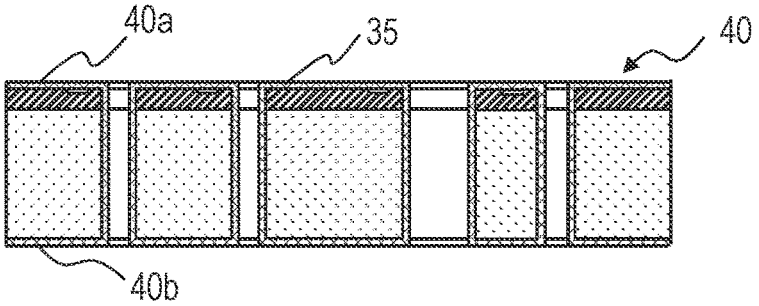
Figure 4C:
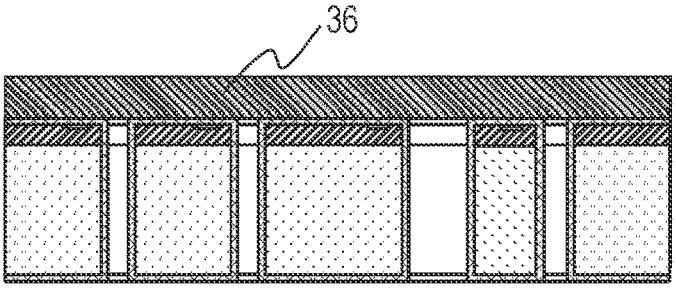
Figure 4D:
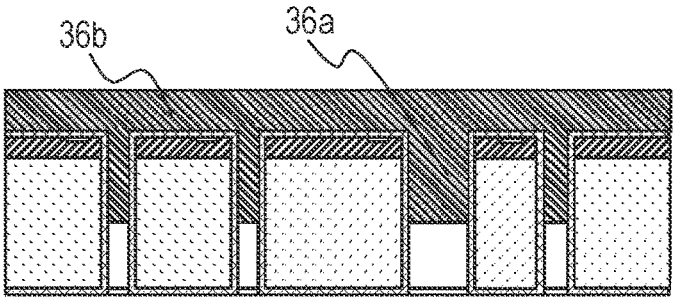
Figure 4E:
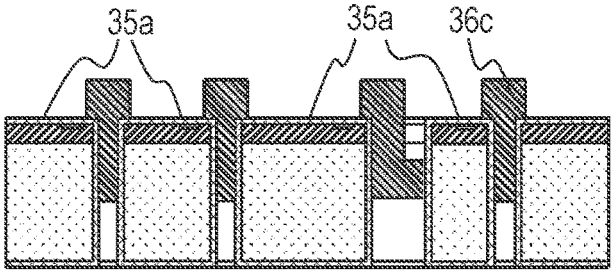
Figure 4F:
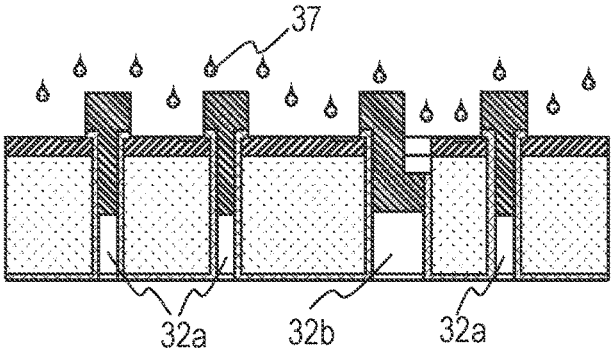
Figure 4G:
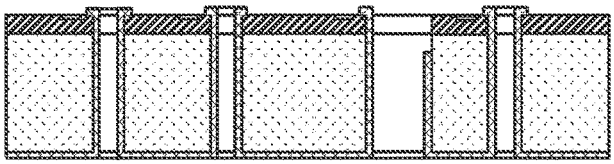
Figure 4H:
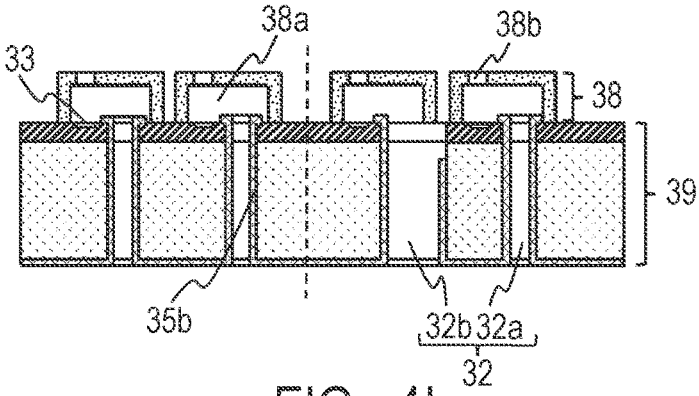

As shown in FIG. 4H, a liquid ejection head that can be obtained by a liquid ejection head manufacturing method according to the present invention includes an element substrate 39, which is a processed perforated substrate, and a nozzle layer 38. The element substrate 39 in turn includes energy generating elements 33 for ejecting liquid and liquid supply ports 32 for supplying liquid. On the other hand, the nozzle layer 38 includes flow paths 38*a* that communicate with respective liquid supply ports and ejection orifices 38*b* that communicate with respective flow paths 38*a* and are designed to eject liquid from there.

(Element Substrate)

A silicon substrate may typically be employed for the element substrate 39 (reference symbol 30 in FIG. 4A). The energy generating elements 33 are only required to generate energy necessary for ejecting liquid (which may typically be recording liquid such as ink) from the respective ejection orifices of the liquid ejection head. The energy generating elements 33 may be electrothermal transducers (heating resistor elements, heater elements) adapted to boil liquid or elements (piezo elements, piezoelectric elements) adapted to apply pressure to liquid by way of volume changes or vibrations. However, the energy generating elements will be described below in terms of heater elements. As shown in FIG. 4H, the element substrate 39 has liquid supply ports 32 that respectively communicate with the corresponding flow paths 38*a* to supply liquid. Note that the liquid supply ports 32 run through the element substrate 39 in the direction that is perpendicular relative to the substrate surfaces and are open at the front surface (the upper surface in FIG. 4H) and also at the rear surface (the lower surface in FIG. 4H) of the element substrate. Also note that the number and the positions of the energy generating elements 33 and those of the liquid supply ports can appropriately be selected depending on the structure of the liquid ejection head to be manufactured.

Electrode pads (not shown) and wires (not shown) for connecting the energy generating elements and the electrode pads may be arranged on the substrate 30. The wires may be contained in an insulating layer (reference symbol 34 in FIG. 4A) made of SiO film or $SiO_2$ film. Furthermore, the element substrate 39 may be provided with protective film 35*b* and insulating film arranged on part of the front surface (the upper surfaces of the energy generating elements are excepted), on the rear surface and on the inner wall surfaces of the liquid supply ports, among others. These films may be made of SiO, $SiO_2$, TiO, silicon nitride, Ta or the like.

(Nozzle Layer)

The ejection orifices (liquid ejection orifices) 38*b* belong to the nozzle layer 38 and are provided to eject liquid. They may typically respectively be formed above the corresponding energy generating elements 33 as shown in FIG. 4H. The flow paths (liquid flow path) 38*a* that also belong to the nozzle layer 38 respectively communicate the corresponding ejection orifices 38*b* and the corresponding liquid supply ports 32 and can be utilized as so many liquid chambers for holding liquid therein. The flow paths 38*a* can be made to include respective foaming chambers as parts thereof. Note that normally a plurality of ejection orifices and a plurality of flow paths are formed in a single liquid ejection head. Epoxy resin can typically be selected and employed as the material for forming the nozzle layer. The nozzle layer may be formed as a single layer or, alternatively, as a multilayer structure having two or more component layers. For example, the nozzle layer may include an orifice plate having ejection orifices and a flow path wall member where flow paths are formed.

<How to Use Liquid Ejection Head>

To execute a recording operation on a recording medium such as a sheet of paper by using the liquid ejection head, the surface of the head bearing the ejection orifices (ejection orifices bearing surface) is placed to face the recording surface of the recording medium. Then, the liquid flown into the element substrate from the liquid supply ports and filled in the flow paths in the nozzle layer is ejected from the ejection orifices by the energy generated from the energy generating elements. Then, a printing (recording) operation takes place as the ejected liquid lands on the recording medium.

<Liquid Ejection Head Manufacturing Method>

A liquid ejection head manufacturing method according to the present invention includes the following steps and utilizes a perforated substrate processing method according to the present invention as described above when etching the parts of the protective film as described below.

- a step of forming a plurality of liquid supply ports running through the substrate of the liquid ejection head (to be referred to as "the second substrate" hereinafter) having a first surface, a second surface arranged opposite to the first surface and energy generating element arranged on the first surface, the liquid supply ports running through the substrate all the way from the first surface to the second surface (liquid supply ports forming step);
- a step of forming a protective film (which may be an insulating film) covering the first surface, the second surface and the inner wall surface of each of the liquid supply ports (protective film forming step);
- a step of etching parts of the protective film including at least the parts thereof covering the energy generating elements (etching step); and
- a step of forming a nozzle layer having flow paths, each communicating at least with one of the liquid supply ports and ejection orifices respectively communicating with the corresponding flow paths on the first surface (nozzle layer forming step).

A liquid ejection head manufacturing method according to the present invention may additionally include the following steps.

- a step of preparing a second substrate (second substrate preparing step);
- a step of dicing the obtained plurality of liquid ejection heads (dicing step); and
- a step of separating liquid ejection heads having no problematic liquid supply ports and liquid ejection heads having problematic (unusable) liquid supply ports (separating step).

Now, each of the above-listed steps will be described in detail below.

(Second Substrate Preparing Step)

To begin with, a second substrate (e.g., a silicon substrate) 31 having a first surface 31*a*, a second surface 31*b* and a plurality of energy generating elements (e.g., heater elements) 33 arranged on the first surface 31*a* is prepared (see FIG. 4A). Wires (not shown) for flowing electric currents to the energy generating elements 33 are connected to the respective energy generating elements 33 and contained in the insulating layer 34. Note that the wires can typically be formed by means of a multilayer wiring technique using photolithography.

(Liquid Supply Ports Forming Step)

Then, a plurality of liquid supply ports 32 that run through the substrate (perpendicularly relative to the substrate surfaces) are formed as shown in FIG. 4A. Techniques that can be used to form the liquid supply ports typically include dry etching techniques such as CDE or ME. Note that the liquid supply ports 32 shown in FIG. 4A include liquid supply ports 32*a* having an intended size and a liquid supply port 32*b* having a size greater than the intended size.

(Protective Film Forming Step)

Subsequently, a protective film (e.g., a TiO film) 35 covering the first surface 31*a*, the second surface 31*b* and the inner wall surface 32*c* of each of the liquid supply ports is formed as shown in FIG. 4B. Note that part of the protective film 35 (as indicated by reference symbol 35*a* in FIG. 4E) becomes the etching object, which etching object is to be removed by etching in an etching step that comes later. More specifically, the part of the protective film that at least includes the part thereof arranged on the first surface at least around the liquid supply ports and covering the energy generating elements becomes the etching object. The protective film 35 can typically be formed by means of techniques such as thermal CVD or ALD or, alternatively, by using liquid such as SOG. Note that the protective film as described here is only an example and may be replaced by some other film such as insulating film.

With a liquid ejection head manufacturing method according to the present invention, it is sufficient for the etching object to be arranged at least around each of the liquid supply ports on the first surface 31*a* without closing a plurality of liquid supply ports 32. In other words, the protective film may or may not be formed on the remaining area of the first surface 31*a* as pointed out above.

A perforated substrate 40 (to be used for a liquid ejection head) having a first surface 40*a* and a second surface 40*b* as well as a plurality of energy generating elements 33, a plurality of liquid supply ports 32 and an etching object can be obtained as a result of executing the above-described steps.

(Etching Step)

Subsequently, part of the protective film including at least the part thereof covering the energy generating elements is etched out by utilizing a perforated substrate processing method according to the present invention as described above. Now, the method will be described in detail hereinafter.

First, a coating layer 36 that covers the etching object (as indicated by reference symbol 35*a* in FIG. 4A) and the plurality of liquid supply ports 32 is formed by causing the resin material to adhere to the first surface 40*a* of the perforated substrate 40 (the first surface 31*a* of the substrate 31) as shown in FIG. 4C (coating layer forming step). With regard to the method of forming the coating layer, the thickness of the coating layer and the resin material to be used for forming the coating layer, the description given above for a perforated substrate processing method according to the present invention is equally applicable here.

Subsequently, the resin material of the coating layer 36 is partly allowed to flow down into each of the plurality of liquid supply ports 32 to close at least part of each of the liquid supply ports with the flowing down resin material as shown in FIG. 4D (closing step). Note that the expression of at least part of each of the liquid supply ports as used herein refers to at least part of each of the liquid supply ports as viewed in the thickness direction thereof (the vertical direction in FIG. 4D). Also note that FIG. 4D shows both the closed portions 36*a* formed by the resin material filled therein and the coating layer 36*b* formed by the resin material remaining on the first surface. The coating layer 36*b* is formed by the resin material left unused in the operation of filling the inside of each of the plurality of liquid supply ports with the resin material. The coating layer 36*b* covers the etching object 35*a* and the plurality of liquid supply ports 32.

The description given earlier for a perforated substrate processing method according to the present invention is also applicable to the technique of allowing the resin material to flow down and fill each of the plurality of liquid supply ports 32 to produce a closed portion there and the profile of each of the liquid supply ports (through holes).

Subsequently, the part of the coating layer 36*b* that covers the etching object 35*a* is removed to expose the etching object, while the part of the coating layer laid on each of the liquid supply ports and having a predetermined profile is left unremoved as so many masks 36*c* so as to leave each of the liquid supply ports in a state of being closed by the resin material as shown in FIG. 4E (patterning step). For this step, it is sufficient for the patterning operation to be conducted under a condition where each of the plurality of liquid supply ports 32 is left closed by at least part of the resin material filled in the inside thereof. In FIG. 4E, it will be seen that the resin material is left at least at part of an upper portion of each of the liquid supply ports 32 (as the coating layer showing a predetermined profile). The specific patterning technique to be used here may be the same as the patterning technique described above for a perforated substrate processing method according to the present invention.

Thereafter, the etching object (the protective film of the region where the resin material has been removed) 35*a* that has been exposed on the first surface of the perforated substrate in the patterning step is etched out by means of etching solution 37, which may typically be buffered hydrofluoric acid, as shown in FIG. 4F. As described above, according to the present invention, it is possible to prevent the etching solution or the etching gas being employed to etch the protective film 35 from getting to the second surface of the perforated substrate and also prevent the adverse effect, if any, of a single through hole (such as a liquid supply port) from adversely affecting other nearby through holes located around it.

Then, the coating layer (resin material) is removed as shown in FIG. 4G (coating layer removing step). The technique for removing the coating layer described earlier for a perforated substrate processing method according to the invention can also be used here.

(Nozzle Layer Forming Step)

Next, a nozzle layer 38 having flow paths 38*a* and ejection orifices 38*b* is formed as shown in FIG. 4H. There are no particular limitations to the method of forming the nozzle layer and any of the techniques known in the field of liquid ejection heads can be employed here. For example, a technique as described below may be employed.

To begin with, a flow path pattern is formed on the element substrate 39 by means of a (e.g., positive type) photosensitive resin material. Subsequently, a coating layer is formed on the photosensitive resin layer. Then, an ejection orifice pattern is formed on the coating layer by means of resist and a dry etching operation is conducted along the pattern to produce ejection orifices in the coating layer. Thus, a nozzle layer having two layers (including an orifice plate having ejection orifices and a flow path wall member having flow paths) can thereafter be formed by eluting the photosensitive resin material for forming the flow path pattern.

(Dicing Step and Separating Step)

Figure 4I:
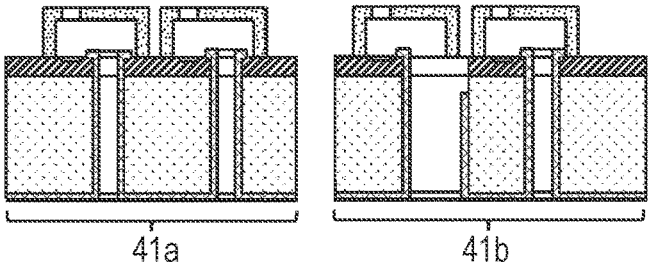

At the time of producing liquid ejection heads, normally, a plurality of chips is arranged in array on a single substrate. Therefore, the obtained substrate where the nozzle layer has been formed is cut by way of a dicing operation and an inspection is executed to separate the chip or chips having one or more problematic liquid supply ports 32*b* from the remaining chips. Then, liquid ejection heads can be obtained by using the chips having only problem-free liquid supply ports 32*a*. More specifically, as shown in FIGS. 4H and 4I, two adjacently located chips are cut apart along the dotted line to separate a usable chip (liquid ejection head) 41*a* and an unusable chip (liquid ejection head) 41*b*.

As described above, according to the present invention, as a result of burying a resin material into the inside of each of the through holes, the buried resin material is left in the inside of the through hole to close the through hole even when the through hole is displaced from its proper position or the through hole shows a too large planar size. For this reason, the etching solution or the etching gas that is being employed does not go around and get to the rear surface of the substrate and hence the occurrence of the problem that a problematic single chip adversely affects the chips located around and adjacent to the former one is suppressed to make it possible to remarkably improve the production yield of wafers.

EXAMPLES

Now, the present invention will be described in greater detail below by way of examples. Note, however, that the examples do not limit the scope of the present invention by any means.

Example 1

Firstly, a second substrate 31 including a monocrystalline silicon substrate 30 was prepared (second substrate preparing step). Heater elements 33 for generating energy for driving liquid to fly had been formed on the first surface 31*a* of the second substrate and a wire (not shown) for flowing electricity had already been connected to each of the heater elements 33. Additionally, the wires were contained in an insulating layer 34 that was made of silicon oxide. They were formed by means of a multilayer wiring technique using photolithography. The thickness of the second substrate (the overall thickness including the thickness of the substrate 30 and the thickness of the insulating layer 34) was 625 μm.

Subsequently, a plurality of liquid supply ports 32 that ran through the second substrate 31 were formed by dry etching (liquid supply ports forming step). At this time, while the liquid supply ports 32*a* were made to show an intended size, the liquid supply port 32*b* showed a size greater than the intended size. The intended hole diameter of the liquid supply ports was 50 μm both at the first surface and at the second surface.

Thereafter, as shown in FIG. 4B, a protective film (against liquid) 35 was formed to prevent the silicon used for the substrate 30 from being eluted into the liquid that was to be ejected (protective film forming step). A TiO film was used for the protective film 35 and the protective film 35 was formed by means of an ALD technique using $TiCl_2$ and $H_2O$. Then, as a result, TiO film was formed as protective film on the first surface 31*a*, on the second surface 31*b* and on the inner wall surfaces 32*c* of the liquid supply ports 32. The thickness of the TiO film was 100 nm. As a result of executing the above-described steps, a perforated substrate 40 as shown in FIG. 4B was obtained (perforated substrate preparing step).

Thereafter, as shown in FIG. 4C, a resin material was made to adhere to the first surface 40*a* to form a coating layer 36 that covers the first surface 40*a* (coating layer forming step). Positive type photosensitive resist having a glass transition point of 80° C., which was prepared by using TZNR-E1050 PM (trade name; available from Tokyo Ohka Kogyo) as base material, was employed as the resin material. The photosensitive resist was turned into a dry film having a film thickness of 20 μm and the first surface 40*a* was laminated with the dry film to make it operate as the coating layer.

Then, as shown in FIG. 4D, the resin material of the coating layer 36 was heated and partly allowed to drop into each of the plurality of liquid supply ports 32 to produce a closed portion 36*a* in the liquid supply port 32 (closing step). Thus, each of the liquid supply ports turned into a state where it was closed by the closed portion. The heating operation was conducted by placing the second substrate on a hot plate whose temperature was controlled to be equal to 130° C. with the second surface 40*b* of the second substrate facing downward (so as to be held in contact with the hot plate) and leaving the second substrate there for 12 minutes. Then, as a result, the inside of each of the liquid supply ports was filled with the resin material to a depth of 100 μm (from the first surface 40*a*).

Subsequently, as shown in FIG. 4E, the coating layer was exposed to light and subjected to a development process for a patterning operation so as to expose the etching object 35*a* on the first surface 40*a* in a state where each of the liquid supply ports was closed by the resin material (patterning step). More specifically, the coating layer was exposed to light at a rate of 5,000 J/m$^2$ and a 2.38 mass % aqueous solution of tetramethylammonium hydroxide (TMAH) was used for the development process. Then, as a result, the resin material that had been exposed to light was dissolved to a depth of 35 μm in the depth direction from the surface of the coating layer (in the vertical direction in FIG. 4E). For this reason, in part of each of the liquid supply ports 32*b*, only the resin material of 20 μm at the side of the first surface 40*a* was dissolved out of the resin material filled in the inside to (a depth of) 100 μm. In other words, the resin material of (the thickness of) 80 μm was left undissolved in the inside of the liquid supply port 32*b*. Thus, the liquid supply ports 32*b* was held closed by the undissolved remaining resin material.

Subsequently, as shown in FIG. 4F, the part of the protective film (etching object) that had been exposed and come out to the surface as a result of the wet etching operation using etching solution was etched, while each of the liquid supply ports was being closed with the resin material (etching step). Buffered hydrofluoric acid was employed as etching solution. A spin etching technique was employed for the etching step because the etching solution could be applied only to one of the surfaces of the substrate with the technique. Note that the etching solution did not flow out onto the second surface of the substrate because the resin material remained in all the liquid supply ports 32 including the liquid supply port 32*b* and hence all the liquid supply ports remained in a closed state. Thus, as a result, no erosion problem due to the etching solution occurred at any of the chips having only problem-free liquid supply ports 32*a*.

Thereafter, as shown in FIG. 4G, the resin material was stripped off (coating layer removing step). The stripping operation was executed by dipping the obtained substrate as shown in FIG. 4F into Stripping Solution 104 (trade name, available from Tokyo Ohka Kogyo), washing the substrate with water and then drying the substrate. As a result, the element substrate 39 was obtained.

Then, a nozzle layer having flow paths 38*a* and ejection orifices 38*b* as shown in FIG. 4H was formed on the element substrate 39 (nozzle layer forming step). The obtained substrate was then cut into chips by means of a dicing operation. The chips 41*b* having one or more problematic liquid supply ports 32*b* as shown in FIG. 4I were separated from the chips 41*a* having only problem-free liquid supply ports 32*a* by way of an inspection process. Thus, the chips 41*a* having only problem-free liquid supply ports 32*a* were sorted out as usable chips.

Thus, the above-described manufacturing method prevented the problematic liquid supply ports, if any, from adversely affecting the problem-free liquid supply ports by etching solution or the like eroding by way of the second surface of the perforated substrate and hence the manufacturing method can prevent any significant fall of production yield of wafers from taking place.

Note that, in this example, the protective film was left unremoved on the inner wall surfaces 32*c* of the liquid supply ports 32 and on the parts of the second surface 31*b* that minimally required the protective film. In other words, no protective film was left unremoved on any of the heater elements 33 so that heating operation was conducted efficiently from the heater elements to the liquid to be ejected to make it possible to reduce the electric power consumption.

Example 2

A perforated substrate was prepared as in Example 1 except that the inner wall surfaces of the through holes were made to show a step 21*c* as shown in FIG. 3A (perforated substrate preparing step). Note that the protective film and the heater elements are not shown in FIGS. 3A through 3D and the stepped profile of the liquid supply ports is not shown in FIGS. 4A through 4I. The thickness of the second substrate was 625 μm as in Example 1 and a step 21 was formed at a depth of 150 μm from the first surface (as indicated by reference symbol 40*a* in FIG. 4B) in each of the inner wall surfaces of the through holes. Each of the steps 21*c* was produced by way of the difference between the opening size of each of the liquid supply ports between the first surface (reference symbol 40*a*) and the second surface (reference symbol 40*b*). The inner wall surface of each of the liquid supply ports was made to run (almost) perpendicularly relative to the substrate surfaces except the stepped part thereof. The opening size of each of the liquid supply ports was made to be equal to 50 μm at the first surface and equal to 100 μm at the second surface. Note that, as in Example 1, the perforated substrate 40 included some liquid supply ports 32*b* having a size greater than the intended size beside liquid supply ports 32*a* having the intended size.

Then, as shown in FIG. 4C, non-photosensitive cyclized rubber was made to adhere to the first surface 40*a* as resin material to form a coating layer 36 having a thickness of 30 μm (as observed from the first surface 40*a*) (coating layer forming step). The cyclized rubber showed a glass transition point of about 45° C.

Subsequently, a heating operation of heating the cyclized rubber of the coating layer 36 was conducted by placing the substrate on a hot plate that had been heated to 90° C. with the second surface 40*b* of the substrate facing downward, leaving the substrate there for 12 minutes. Then, as a result, part of the cyclized rubber was allowed to drop into each of the liquid supply ports down to the step (located at a position 150 μm deep from the first surface 40*a*) as shown in FIG. 4D (closing step). The heating operation by means of the hot plate was continued for additional 10 minutes but the cyclized rubber did not drop further down from the step of each of the liquid supply ports toward the second surface.

Then, referring to FIG. 4E, the coating layer was subjected to a patterning operation, using RIE, to expose the etching object 35*a* (patterning step). More specifically, positive type resist was applied onto the coating layer to a thickness of 30 μm, exposed to light and subjected to a development process to produce a resist pattern to be used for patterning the coating layer. Thereafter, the coating layer was etched by a depth (thickness) of 40 μm in the direction of film thickness (in the vertical direction in FIG. 4E) by means of RIE using gas containing $O_2$ gas as principal ingredient. Then, as a result, the cyclized rubber partly filled in each of the liquid supply ports 32*b* to a depth of 150 μm from the first surface 40*a* to produce a closed portion was etched only by 20 μm from the first surface. Thus, as a result, the resin material of (the thickness of) 130 μm was left in each of the liquid supply ports. Each of the liquid supply ports 32*b* was left closed by the remaining resin material. Thereafter, liquid ejection heads were produced by following the remaining manufacturing steps as in Example 1.

Thus, the above-described manufacturing method prevented the problematic liquid supply ports, if any, from adversely affecting the problem-free liquid supply ports by etching solution or the like eroding by way of the second surface of the perforated substrate and hence also prevented any significant fall of production yield of wafers from taking place.

The present invention can be used for processing methods that involve an etching operation to be conducted on perforated substrates of any types. More specifically, the present invention is applicable to liquid ejection heads to be mounted in various apparatus such as inkjet printers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-199510, filed Oct. 13, 2017, which is hereby incorporated by reference herein in its entirety.

What is claimed is:

1. A perforated substrate processing method having a step of etching an etching object on a perforated substrate, the substrate having a first surface, a second surface located opposite to the first surface, and a plurality of through holes running through the substrate from the first surface to the second surface, wherein the etching object is arranged on the first surface of the perforated substrate at least around the through holes without closing the through holes, the method comprising:

a step of preparing the perforated substrate;

a step of forming a coating layer containing a resin material on the first surface of the perforated substrate;

a closing step of allowing part of the resin material to drop into each of the plurality of through holes so as to close each of the through holes at least partly with the dropped resin material;

a patterning step of leaving the coating layer on each of the through holes as mask while removing at least part of the coating layer covering the etching object to expose the etching object; and a step of etching the exposed etching object under a condition where each of the through holes is closed at least partly with the resin material.

2. The method according to claim 1, wherein the perforated substrate has a film covering the first surface, the second surface and the inner wall surface of each of the through holes, at least part of the film arranged on the first surface being the etching object, and the step of preparing the perforated substrate includes a step of forming a film for covering the first surface, the second surface and the inner wall surface of each of the through holes.

3. The method according to claim 1, wherein each of the through holes has a first diameter at the first surface and a second diameter at the second surface is, the second diameter being greater than the first diameter, and the inner wall surface of each of the through holes has a step attributable to the difference between the first diameter and the second diameter.

4. The method according to claim 1, wherein the patterning step is executed under a condition where at least part of the resin material dropped into each of the plurality of through holes remains such that each of the through holes is held closed by the remaining resin material.

5. The method according to claim 1, wherein the closing step is a step of allowing part of the resin material of the coating layer to drop into each of the plurality of through holes by heating the resin material so as to close each of the through holes at least partly with the dropped resin material.

6. The method according to claim 5, wherein the resin material has a glass transition point and is heated to a temperature higher than the glass transition point in the closing step.

7. The method according to claim 1, wherein the resin material does not have photosensitivity and the patterning step is executed by means of dry etching using a resist for patterning the part covering the etching object of the coating layer, provided that the coating layer is etched by means of dry etching to a depth shallower than a bottom of the resin material dropped into each of the plurality of through holes such that the resin material dropped into each of the plurality of through holes remains at least partly so as to allow each of the through holes to be held closed by the remaining resin material.

8. The method according to claim 7, wherein the dry etching is reactive ion etching.

9. The method according to claim 1, wherein the resin material has photosensitivity and the patterning step is a step of removing the part covering the etching object of the coating layer and exposing the etching object by subjecting the resin material to light exposure and development.

10. The method according to claim 9, wherein the resin material is a positive type photosensitive resin.

11. The method according to claim 10, wherein at least part of the resin material dropped into each of the plurality of through holes is made to remain such that each of the through holes is held closed by the remaining resin material by adjusting a light exposure amount so as not to allow exposure light to get to a bottom of the resin material dropped into each of the plurality of through holes.

12. The method according to claim 10, wherein at least part of the resin material dropped into each of the plurality of through holes is made to remain such that each of the through holes is held closed by the remaining resin material by selecting a shallow depth of focus as a lighting condition for the light exposure so as not to allow exposure light to get to a bottom of the resin material dropped into each of the plurality of through holes.

13. The method according to claim 10, wherein the resin material contains naphthoquinone diazide.

14. A method of manufacturing a liquid ejection head having an element substrate including energy generating elements for ejecting liquid and liquid supply ports for supplying liquid, flow paths respectively communicating with the corresponding liquid supply ports and a nozzle layer including ejection orifices respectively communicating with the corresponding flow paths to eject liquid, the method comprising:

a step of forming a plurality of liquid supply ports on a substrate having a first surface, a second surface located opposite to the first surface, and energy generating elements arranged on the first surface, the liquid supply ports running through the substrate from the first surface to the second surface;

a step of forming a protective film covering the first surface, the second surface and an inner wall surface of each of the liquid supply ports;

a step of etching at least parts covering the energy generating elements of the protective film; and a step of forming the flow paths, each communicating with at least one of the liquid supply ports, and the nozzle layer having the ejection orifices communicating respectively with the corresponding flow paths, on the first surface, wherein the step of etching the protective film utilizing a perforated substrate processing method according to claim 1.

* * * * *